US008213624B2

(12) United States Patent
Seefeldt

(10) Patent No.: US 8,213,624 B2
(45) Date of Patent: Jul. 3, 2012

(54) LOUDNESS MEASUREMENT WITH SPECTRAL MODIFICATIONS

(75) Inventor: Alan Seefeldt, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 252 days.

(21) Appl. No.: 12/531,692

(22) PCT Filed: Jun. 18, 2008

(86) PCT No.: PCT/US2008/007570

§ 371 (c)(1),
(2), (4) Date: Sep. 16, 2009

(87) PCT Pub. No.: WO2008/156774

PCT Pub. Date: Dec. 24, 2008

(65) Prior Publication Data

US 2010/0067709 A1 Mar. 18, 2010

Related U.S. Application Data

(60) Provisional application No. 60/936,356, filed on Jun. 19, 2007.

(51) Int. Cl.
*H04R 29/00* (2006.01)

(52) U.S. Cl. ..... 381/56; 381/98; 381/102; 381/107; 381/109; 381/104; 704/201; 704/225

(58) Field of Classification Search ..... 381/56, 381/57, 58, 59, 107, 104, 106, 109, 102, 381/98, 101, 103; 700/94; 704/225
See application file for complete search history.

(56) References Cited

U.S. PATENT DOCUMENTS

| | | | | |
|---|---|---|---|---|
| 2,808,475 | A | 10/1957 | Stryker | |
| 5,274,711 | A * | 12/1993 | Rutledge et al. | 704/225 |
| 5,377,277 | A | 12/1994 | Bisping | |
| RE34,961 | E | 6/1995 | Widin et al. | |
| 5,812,969 | A * | 9/1998 | Barber et al. | 704/224 |
| 6,556,682 | B1 * | 4/2003 | Gilloire et al. | 381/66 |
| 2004/0044525 | A1 * | 3/2004 | Vinton et al. | 704/224 |
| 2004/0190740 | A1 * | 9/2004 | Chalupper et al. | 381/317 |
| 2005/0113147 | A1 * | 5/2005 | VanEpps et al. | 455/567 |
| 2005/0276425 | A1 * | 12/2005 | Forrester et al. | 381/104 |
| 2005/0278165 | A1 * | 12/2005 | Boillot et al. | 704/200.1 |
| 2007/0092089 | A1 | 4/2007 | Seefeldt et al. | |
| 2007/0291960 | A1 * | 12/2007 | Sekiguchi | 381/107 |

FOREIGN PATENT DOCUMENTS

JP 2008-176695 7/2008

(Continued)

OTHER PUBLICATIONS

Seefeldt et al, Pratical Program Loudness Measurement for Effective loudness Control,AES,2005.*

(Continued)

*Primary Examiner* — Davetta W Goins
*Assistant Examiner* — Kuassi Ganmavo

(57) ABSTRACT

The perceived loudness of an audio signal is measured by modifying a spectral representation of an audio signal as a function of a reference spectral shape so that the spectral representation of the audio signal conforms more closely to the reference spectral shape, and determining the perceived loudness of the modified spectral representation of the audio signal.

9 Claims, 5 Drawing Sheets

FOREIGN PATENT DOCUMENTS

| | | | | |
|---|---|---|---|---|
| RU | 2279759 | | | 7/2006 |
| WO | 2004/111994 | | | 12/2004 |
| WO | 2004/111994 | A2 | | 12/2004 |
| WO | WO 2006/003536 | | * | 1/2006 |
| WO | 2006/047600 | | | 5/2006 |

OTHER PUBLICATIONS

Australian Government IP Australia, Examiner's first report on patent application No. 2005299410, mailed Jun. 25, 2009 Australian Patent Appln. No. 2005299410.

Israel Patent Office, Examiner's Report on Israel Application No. 182097 mailed Apr. 11, 2010, Israel Patent Appin. No. 182097.

Intellectual Property Corporation of Malaysia, Substantive/Modified Substantive Examination Adverse Report (Section 30(1)/30(2)) and Search Report, dated Dec. 5, 2008, Malaysian Patent Appln. No. PI 20055232.

Dept of Justice & Human Rights of Republic of Indonesia, Directorate General Intellectual Property Rights, First Office Action, Indonesian Patent Appln. No. WO0200701285.

State Intellectual Property Office of the People'S Republic of China, Notification of the Third Office Action, mailed Apr. 21, 2010, China Patent Appin. No. 200580036760.7.

European Patent Office Searching Authority, Int'l Search Report and Written Opinion, Int'l Appln. No. PCT/US2004/016964, mailed Jun. 20, 2005.

Seefeldt, Alan, et al., "A New Objective Measure of Perceived Loudness", Audio Engineering Society Convention Paper 6236, San Francisco, CA, Oct. 28, 2004.

Soulodre, Gilbert A., "Evaluation of Objective Loudness Meters", Audio Engineering Society Convention Paper 6161, Berlin, Germany, May 8-11, 2004.

PCT International Search Report mailed Sep. 10, 2008.

PCT Written Opinion of the Int'l Search Authority mailed Sep. 10, 2008.

Int'l Standard, "Acoustics—Method for calculating loudness level", ISO 532-1975 (E), pp. 411-428 (1-18).

* cited by examiner

LOUDNESS MEASUREMENT WITH SPECTRAL MODIFICATIONS

TECHNICAL FIELD

The invention relates to audio signal processing. In particular, the invention relates to measuring the perceived loudness of an audio signal by modifying a spectral representation of an audio signal as a function of a reference spectral shape so that the spectral representation of the audio signal conforms more closely to the reference spectral shape, and calculating the perceived loudness of the modified spectral representation of the audio signal.

REFERENCES AND INCORPORATION BY REFERENCE

Certain techniques for objectively measuring perceived (psychoacoustic) loudness useful in better understanding aspects the present invention are described in published International patent application WO 2004/111994 A2, of Alan Jeffrey Seefeldt et al, published Dec. 23, 2004, entitled "Method, Apparatus and Computer Program for Calculating and Adjusting the Perceived Loudness of an Audio Signal", in the resulting U.S. Patent Application published as US 2007/0092089, published Apr. 26, 2007, and in "A New Objective Measure of Perceived Loudness" by Alan Seefeldt et al, Audio Engineering Society Convention Paper 6236, San Francisco, Oct. 28, 2004. Said WO 2004/111994 A2 and US 2007/0092089 applications and said paper are hereby incorporated by reference in their entirety.

BACKGROUND ART

Many methods exist for objectively measuring the perceived loudness of audio signals. Examples of methods include A-, B- and C-weighted power measures as well as psychoacoustic models of loudness such as described in "Acoustics—Method for calculating loudness level," ISO 532 (1975) and said WO 2004/111994 A2 and US 2007/0092089 applications. Weighted power measures operate by taking an input audio signal, applying a known filter that emphasizes more perceptibly sensitive frequencies while deemphasizing less perceptibly sensitive frequencies, and then averaging the power of the filtered signal over a predetermined length of time. Psychoacoustic methods are typically more complex and aim to model better the workings of the human ear. Such psychoacoustic methods divide the signal into frequency bands that mimic the frequency response and sensitivity of the ear, and then manipulate and integrate such bands while taking into account psychoacoustic phenomenon, such as frequency and temporal masking, as well as the non-linear perception of loudness with varying signal intensity. The aim of all such methods is to derive a numerical measurement that closely matches the subjective impression of the audio signal.

The inventor has found that the described objective loudness measurements fail to match subjective impressions accurately for certain types of audio signals. In said WO 2004/111994 A2 and US 2007/0092089 applications such problem signals were described as "narrowband", meaning that the majority of the signal energy is concentrated in one or several small portions of the audible spectrum. In said applications, a method to deal with such signals was disclosed involving the modification of a traditional psychoacoustic model of loudness perception to incorporate two growth of loudness functions: one for "wideband" signals and a second for "narrowband" signals. The WO 2004/111994 A2 and US 2007/0092089 applications describe an interpolation between the two functions based on a measure of the signal's "narrowbandedness".

While such an interpolation method does improve the performance of the objective loudness measurement with respect to subjective impressions, the inventor has since developed an alternate psychoacoustic model of loudness perception that he believes explains and resolves the differences between objective and subjective loudness measurements for "narrowband" problem signals in a better manner. The application of such an alternative model to the objective measurement of loudness constitutes an aspect of the present invention.

DISCLOSURE OF THE INVENTION

Figure 1:
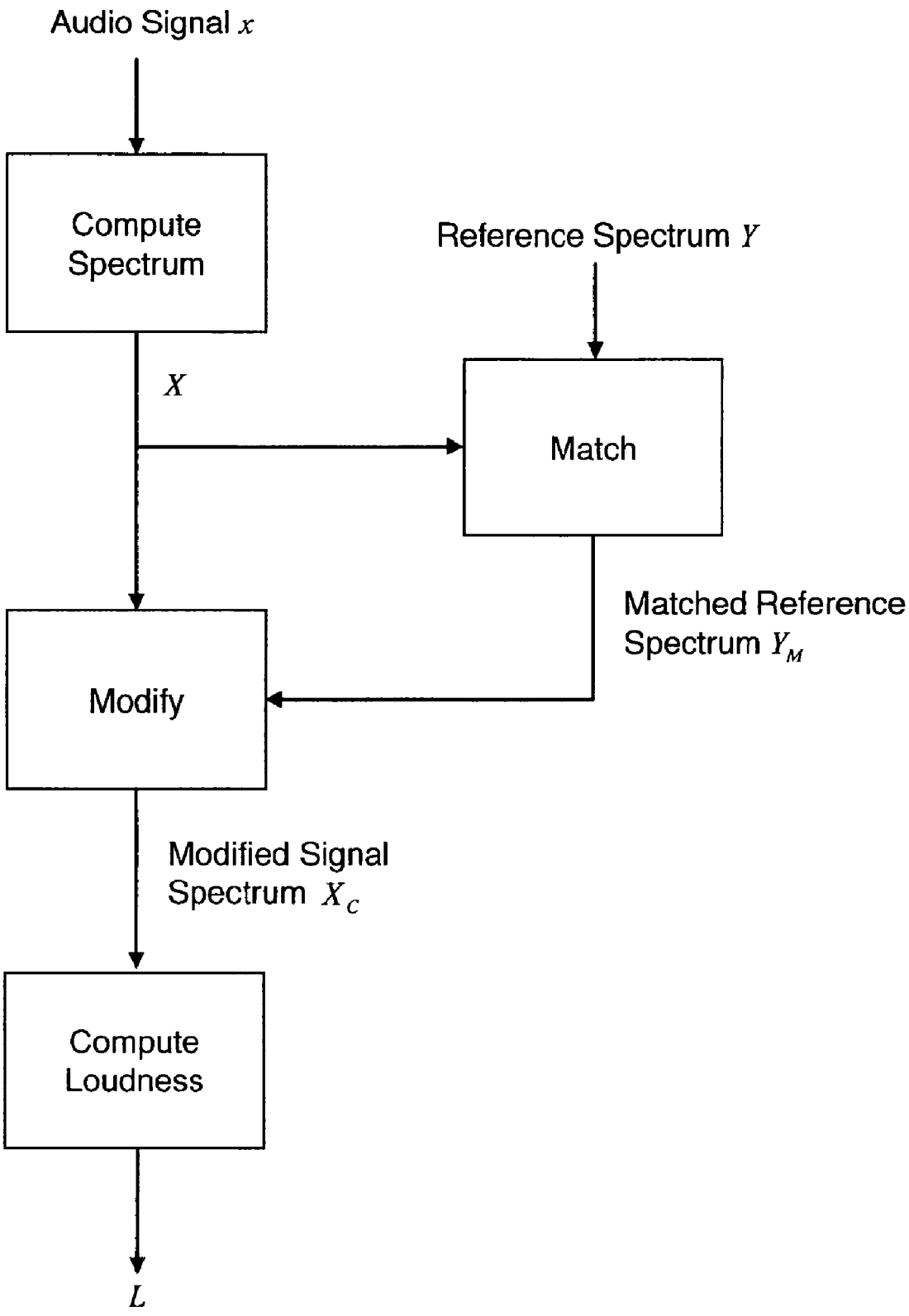
FIG. 1 shows a simplified schematic block diagram of aspects of the present invention.

According to aspects of the invention, a method for measuring the perceived loudness of an audio signal, comprises obtaining a spectral representation of the audio signal, modifying the spectral representation as a function of a reference spectral shape so that the spectral representation of the audio signal conforms more closely to a reference spectral shape, and calculating the perceived loudness of the modified spectral representation of the audio signal. Modifying the spectral representation as a function of a reference spectral shape may include minimizing a function of the differences between the spectral representation and the reference spectral shape and setting a level for the reference spectral shape in response to the minimizing. Minimizing a function of the differences may minimize a weighted average of differences between the spectral representation and the reference spectral shape. Minimizing a function of the differences may further include applying an offset to alter the differences between the spectral representation and the reference spectral shape. The offset may be a fixed offset. Modifying the spectral representation as a function of a reference spectral shape may further include taking the maximum level of the spectral representation of the audio signal and of the level-set reference spectral shape. The spectral representation of the audio signal may be an excitation signal that approximates the distribution of energy along the basilar membrane of the inner ear.

According to further aspects of the invention, a method of measuring the perceived loudness of an audio signal comprises obtaining a representation of the audio signal, comparing the representation of the audio signal to a reference representation to determine how closely the representation of the audio signal matches the reference representation, modifying at least a portion of the representation of the audio signal so that the resulting modified representation of the audio signal matches more closely the reference representation, and determining a perceived loudness of the audio signal from the modified representation of the audio signal. Modifying at least a portion of the representation of the audio signal may include adjusting the level of the reference representation with respect to the level of the representation of the audio signal. The level of the reference representation may be adjusted so as to minimize a function of the differences between the level of the reference representation and the level of the representation of the audio signal. Modifying at least a portion of the representation of the audio signal may include increasing the level of portions of the audio signal.

According to yet further aspects of the invention, a method of determining the perceived loudness of an audio signal comprises obtaining a representation of the audio signal, comparing the spectral shape of the audio signal representation to a reference spectral shape, adjusting a level of the reference spectral shape to match the spectral shape of the audio signal representation so that differences between the spectral shape of the audio signal representation and the reference spectral shape are reduced, forming a modified spectral shape of the audio signal representation by increasing portions of the spectral shape of the audio signal representation to improve further the match between the spectral shape of the audio signal representation and the reference spectral shape, and determining a perceived loudness of the audio signal based upon the modified spectral shape of the audio signal representation. The adjusting may include minimizing a function of the differences between the spectral shape of the audio signal representation and the reference spectral shape and setting a level for the reference spectral shape in response to the minimizing. Minimizing a function of the differences may minimize a weighted average of differences between the spectral shape of the audio signal representation and the reference spectral shape. Minimizing a function of the differences further may include applying an offset to alter the differences between the spectral shape of the audio signal representation and the reference spectral shape. The offset may be a fixed offset. Modifying the spectral representation as a function of a reference spectral shape may further include taking the maximum level of the spectral representation of the audio signal and of the level-set reference spectral shape.

According to the further aspects and yet further aspects of the present invention, the audio signal representation may be an excitation signal that approximates the distribution of energy along the basilar membrane of the inner ear.

Other aspects of the invention include apparatus performing any of the above-recited methods and a computer program, stored on a computer-readable medium for causing a computer to perform any of the above-recited methods.

BEST MODE FOR CARRYING OUT THE INVENTION

In a general sense, all of the objective loudness measurements mentioned earlier (both weighted power measurements and psychoacoustic models) may be viewed as integrating across frequency some representation of the spectrum of the audio signal. In the case of weighted power measurements, this spectrum is the power spectrum of the signal multiplied by the power spectrum of the chosen weighting filter. In the case of a psychoacoustic model, this spectrum may be a non-linear function of the power within a series of consecutive critical bands. As mentioned before, such objective measures of loudness have been found to provide reduced performance for audio signals possessing a spectrum previously described as "narrowband".

Rather than viewing such signals as narrowband, the inventor has developed a simpler and more intuitive explanation based on the premise that such signals are dissimilar to the average spectral shape of ordinary sounds. It may be argued that most sounds encountered in everyday life, particularly speech, possess a spectral shape that does not diverge too significantly from an average "expected" spectral shape. This average spectral shape exhibits a general decrease in energy with increasing frequency that is band-passed between the lowest and highest audible frequencies. When one assesses the loudness of a sound possessing a spectrum that deviates significantly from such an average spectral shape, it is the present inventor's hypothesis that one cognitively "fills in" to a certain degree those areas of the spectrum that lack the expected energy. The overall impression of loudness is then obtained by integrating across frequency a modified spectrum that includes a cognitively "filled in" spectral portion rather than the actual signal spectrum. For example, if one were listening to a piece of music with just a bass guitar playing, one would generally expect other instruments eventually to join the bass and fill out the spectrum. Rather than judge the overall loudness of the soloing bass from its spectrum alone, the present inventor believes that a portion of the overall perception of loudness is attributed to the missing frequencies that one expects to accompany the bass. An analogy may be drawn with the well-known "missing fundamental" effect in psychoacoustics. If one hears a series of harmonically related tones, but the fundamental frequency of the series is absent, one still perceives the series as having a pitch corresponding to the frequency of the absent fundamental.

In accordance with aspects of the present invention, the above-hypothesized subjective phenomenon is integrated into an objective measure of perceived loudness. FIG. 1 depicts an overview of aspects of the invention as it applies to any of the objective measures already mentioned (i.e., both weighted power models and psychoacoustic models). As a first step, an audio signal x may be transformed to a spectral representation X commensurate with the particular objective loudness measure being used. A fixed reference spectrum Y represents the hypothetical average expected spectral shape discussed above. This reference spectrum may be pre-computed, for example, by averaging the spectra of a representative database of ordinary sounds. As a next step, a reference spectrum Y may be "matched" to the signal spectrum X to generate a level-set reference spectrum $Y_M$. Matching is meant that $Y_M$ is generated as a level scaling of Y so that the level of the matched reference spectrum $Y_M$, is aligned with X, the alignment being a function of the level difference between X and $Y_M$ across frequency. The level alignment may include a minimization of a weighted or unweighted difference between X and $Y_M$ across frequency. Such weighting may be defined in any number of ways but may be chosen so that the portions of the spectrum X that deviate most from the reference spectrum Y are weighted most heavily. In that way, the most "unusual" portions of the signal spectrum X are aligned closest to $Y_M$. Next a modified signal spectrum $X_C$ is generated by modifying X to be close to the matched reference spectrum $Y_M$ according to a modification criterion. As will be detailed below, this modification may take the form of simply selecting the maximum of X and $Y_M$ across frequency, which simulates the cognitive "filling in" discussed above. Finally, the modified signal spectrum $X_C$ may be processed according to the selected objective loudness measure (i.e., some type of integration across frequency) to produce an objective loudness value L.

Figure 2A:
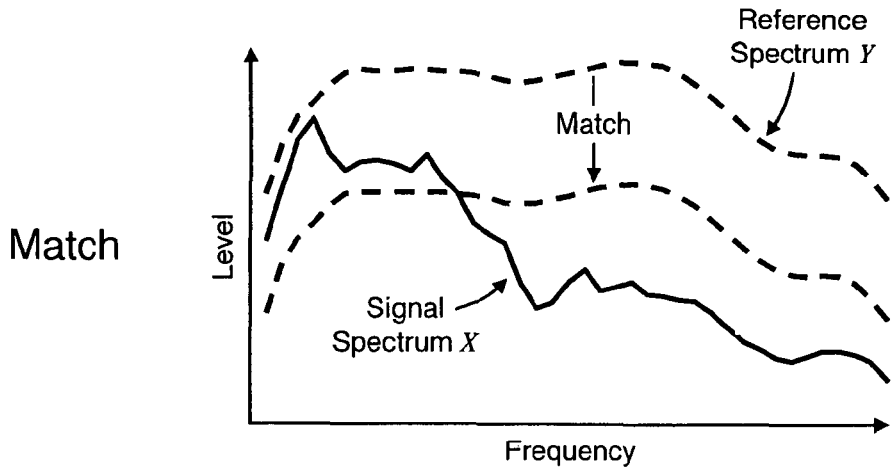
FIGS. 2A, B, and C show, in a conceptualized manner, an example of the application of spectral modifications, in accordance with aspects of the invention, to an idealized audio spectrum that contains predominantly bass frequencies.
Figure 2B:
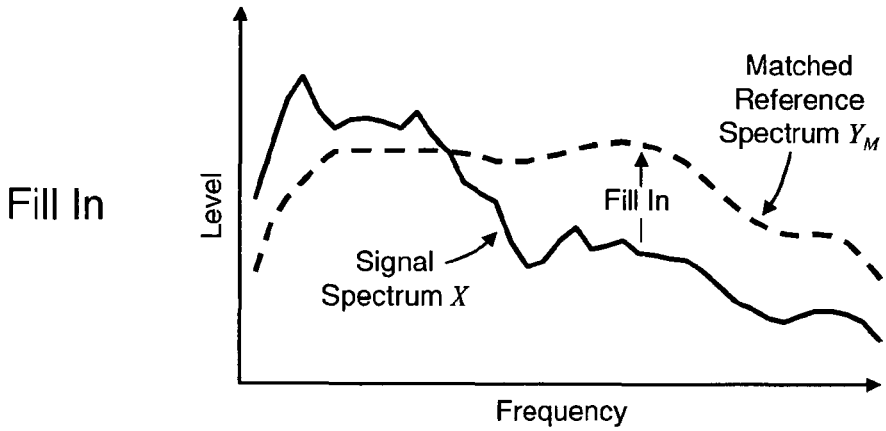
Figure 2C:
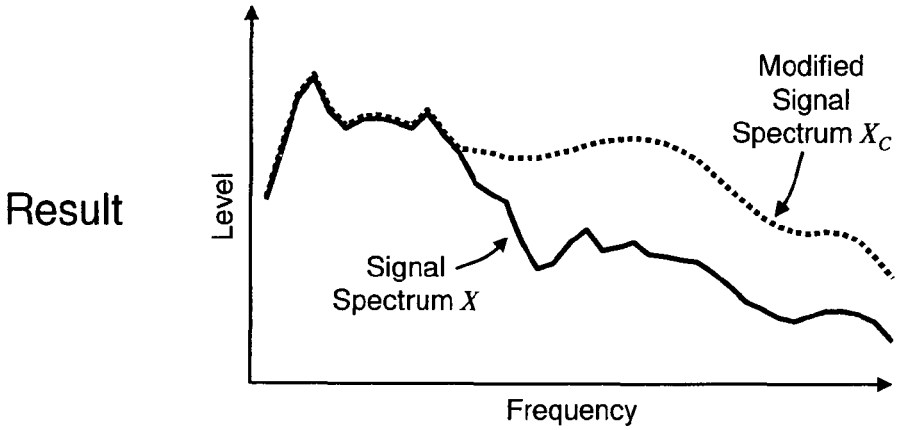

FIGS. 2A-C and 3A-C depict, respectively, examples of the computation of modified signal spectra $X_C$ for two different original signal spectra X. In FIG. 2A, the original signal spectrum X, represented by the solid line, contains the majority of its energy in the bass frequencies. In comparison to a depicted reference spectrum Y, represented by the dashed lines, the shape of the signal spectrum X is considered "unusual". In FIG. 2A, the reference spectrum is initially shown at an arbitrary starting level (the upper dashed line) in which it is above the signal spectrum X. The reference spectrum Y may then be scaled down in level to match the signal spectrum X creating a matched reference spectrum $Y_M$, (the lower dashed line). One may note that $Y_M$ is matched most closely with the bass frequencies of X, which may be considered the "unusual" part of the signal spectrum when compared to the reference spectrum. In FIG. 2B, those portions of the signal spectrum X falling below the matched reference spectrum $Y_M$ are made equal to $V_M$, thereby modeling the cognitive "filling in" process. In FIG. 2C, one sees the result that the modified signal spectrum $X_C$, represented by the dotted line, is equal to the maximum of X and $Y_M$ across frequency. In this case, the application of the spectral modification has added a significant amount of energy to the original signal spectrum at the higher frequencies. As a result, the loudness computed from the modified signal spectrum $X_C$ is larger than what would have been computed from the original signal spectrum X, which is the desired effect.

Figure 3A:
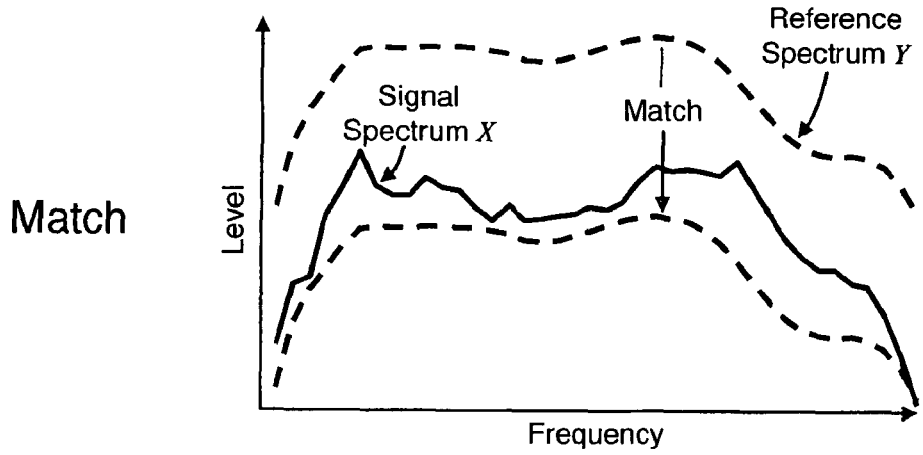
FIGS. 3A, B, and C show, in a conceptualized manner, an example of the application of spectral modifications, in accordance with aspects of the present invention, to an idealized audio spectrum that is similar to a reference spectrum.
Figure 3B:
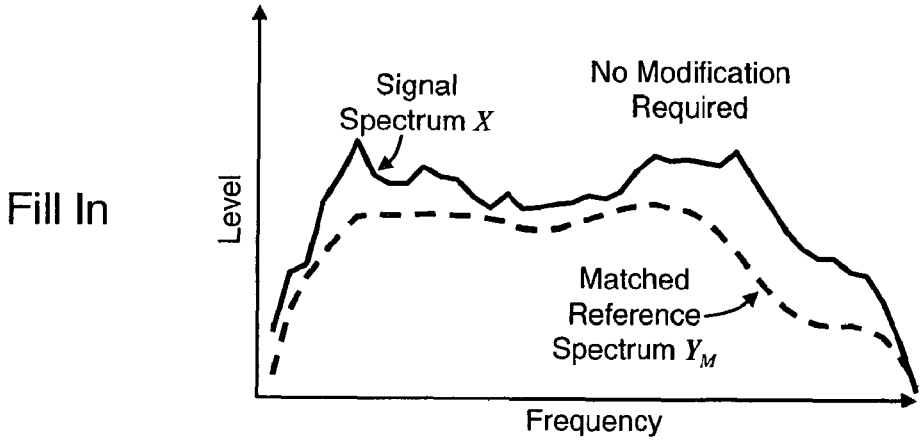
Figure 3C:
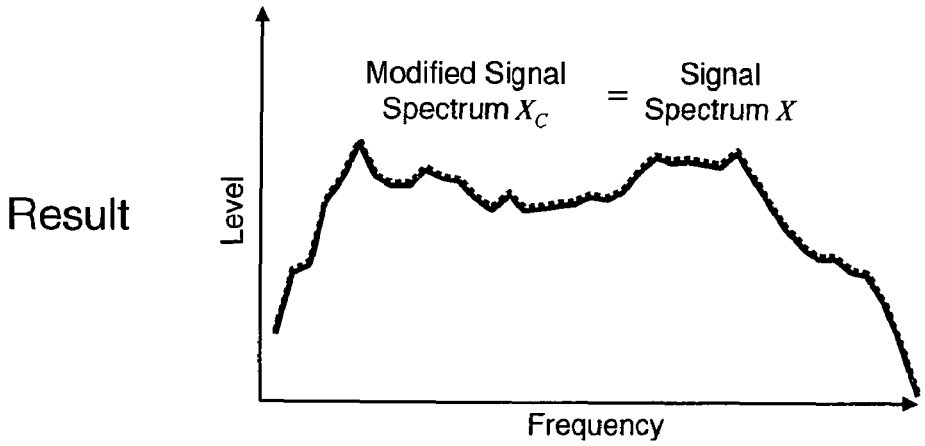

In FIGS. 3A-C, the signal spectrum X is similar in shape to the reference spectrum Y. As a result, a matched reference spectrum $Y_M$ may fall below the signal spectrum X at all frequencies and the modified signal spectrum $X_C$ may be equal to original signal spectrum X In this example, the modification does not affect the subsequent loudness measurement in any way. For the majority of signals, their spectra are close enough to the modified spectrum, as in FIGS. 3A-C, such that no modification is applied and therefore no change to the loudness computation occurs. Preferably, only "unusual" spectra, as in FIGS. 2A-C, are modified.

In said WO 2004/111994 A2 and US 2007/0092089 applications, Seefeldt et al disclose, among other things, an objective measure of perceived loudness based on a psychoacoustic model. The preferred embodiment of the present invention may apply the described spectral modification to such a psychoacoustic model. The model, without the modification, is first reviewed, and then the details of the modification's application are presented.

Figure 4:
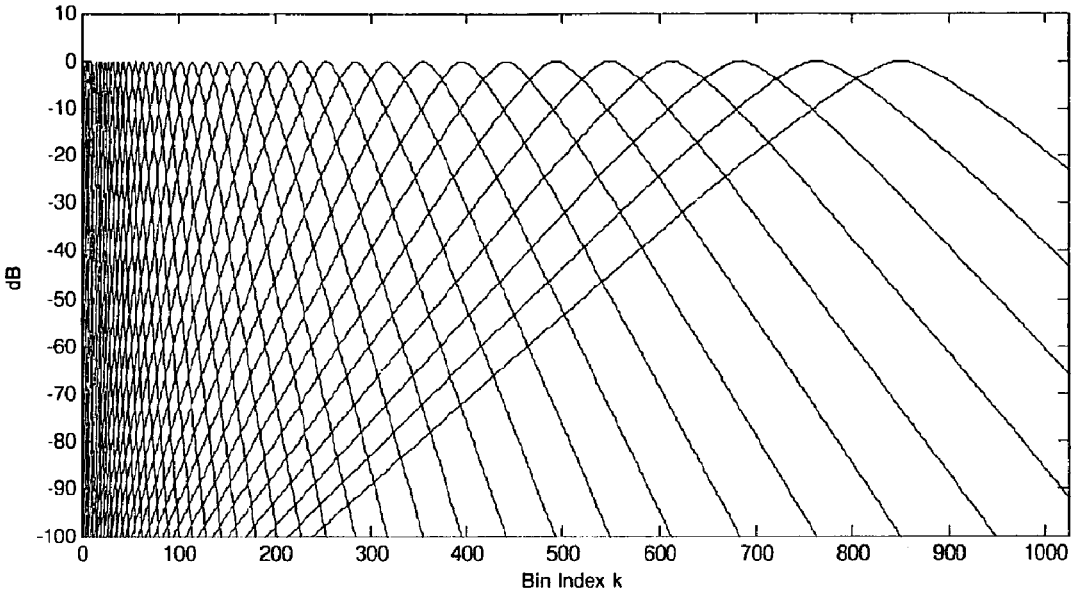
FIG. 4 shows a set of critical band filter responses useful for computing an excitation signal for a psychoacoustic loudness model.

From an audio signal, x[n] , the psychoacoustic model first computes an excitation signal E[b,t] approximating the distribution of energy along the basilar membrane of the inner ear at critical band b during time block t. This excitation may be computed from the Short-time Discrete Fourier Transform (STDFT) of the audio signal as follows $$E[b,t] = \lambda_b E[b,t-1] + (1-\lambda_b)\sum_k |T[k]|^2 |C_b[k]|^2 |X[k,t]|^2 \quad (1)$$

where X[k,t] represents the STDFT of x[n] at time block t and bin k, where k is the frequency bin index in the transform, T[k] represents the frequency response of a filter simulating the transmission of audio through the outer and middle ear, and $C_b[k]$ represents the frequency response of the basilar membrane at a location corresponding to critical band b. FIG. 4 depicts a suitable set of critical band filter responses in which forty bands are spaced uniformly along the Equivalent Rectangular Bandwidth (ERB) scale, as defined by Moore and Glasberg (B. C. J. Moore, B. Glasberg, T. Baer, "A Model for the Prediction of Thresholds, Loudness, and Partial Loudness," *Journal of the Audio Engineering Society*, Vol. 45, No. 4, April 1997, pp. 224-240). Each filter shape is described by a rounded exponential function and the bands are distributed using a spacing of 1 ERB. Lastly, the smoothing time constant $\lambda_b$ in (1) may he advantageously chosen proportionate to the integration time of human loudness perception within band b.

Figure 5:
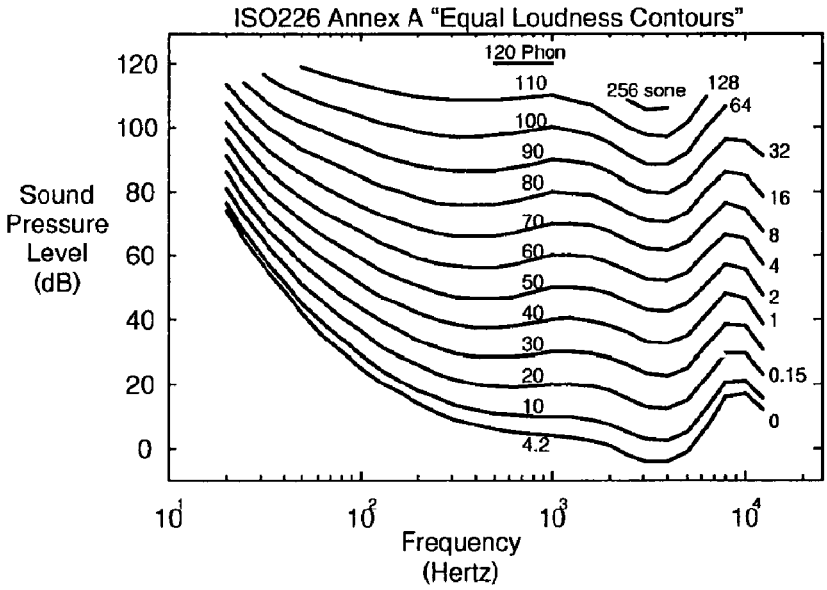
FIG. 5 shows the equal loudness contours of ISO 226. The horizontal scale is frequency in Hertz (logarithmic base 10 scale) and the vertical scale is sound pressure level in decibels.

Using equal loudness contours, such as those depicted in FIG. 5, the excitation at each band is transformed into an excitation level that would generate the same loudness at 1 kHz. Specific loudness, a measure of perceptual loudness distributed across frequency and time, is then computed from the transformed excitation, $E_{1\,kHz}[b,t]$, through a compressive non-linearity. One such suitable function to compute the specific loudness N[b,t] is given by:

$$N[b,t] = \beta\left(\left(\frac{E_{1\,kHz}[b,t]}{TQ_{1\,kHz}}\right)^{\alpha} - 1\right) \quad (2)$$

where $TQ_{1\,kHz}$ is the threshold in quiet at 1 kHz and the constants β and α are chosen to match to subjective impression of loudness growth for a 1 kHz tone. Although a value of 0.24 for β and α value of 0.045 for α have been found to be suitable, those values are not critical. Finally, the total loudness, L[t], represented in units of sone, is computed by summing the specific loudness across bands:

$$L[t] = \sum_b N[b,t] \quad (3)$$

In this psychoacoustic model, there exist two intermediate spectral representations of the audio prior to the computation of the total loudness: the excitation E[b,t] and the specific loudness N[b,t]. For the present invention, the spectral modification may be applied to either, but applying the modification to the excitation rather than the specific loudness simplifies calculations. This is because the shape of the excitation across frequency is invariant to the overall level of the audio signal. This is reflected in the manner in which the spectra retain the same shape at varying levels, as shown in FIGS. 2A-C and 3A-C. Such is not the case with specific loudness due to the nonlinearity in Eqn. 2. Thus, the examples given herein apply spectral modifications to an excitation spectral representation.

Proceeding with the application of the spectral modification to the excitation, a fixed reference excitation Y[b] is assumed to exist. In practice, Y[b] may be created by averaging the excitations computed from a database of sounds containing a large number of speech signals. The source of a reference excitation spectrum Y[b] is not critical to the invention. In applying the modification, it is useful to work with decibel representations of the signal excitation E[b,t] and the reference excitation Y[b]:

$$EdB[b,t]=10\log_{10}(E[b,t]) \quad (4a)$$

$$YdB[b]=10\log_{10}(Y[b]) \quad (4b)$$

As a first step, the decibel reference excitation YdB[b] may be matched to the decibel signal excitation EdB[b,t] to generate the matched decibel reference excitation $YdB_M[b]$, where $YdB_M[b]$ is represented as a scaling (or additive offset when using dB) of the reference excitation:

$$YdB_M[b]=YdB[b]+\Delta_M \quad (5)$$

The matching offset $\Delta_M$ is computed as a function of the difference, Δ[b], between EdB[b,t] and YdB[b]:

$$\Delta[b]=EdB[b,t]-YdB[b] \quad (6)$$

From this difference excitation, Δ[b], a weighting, W[b], is computed as the difference excitation normalized to have a minimum of zero and then raised to a power γ:

$$W[b]=\left(\Delta[b]-\min_b\{\Delta[b]\}\right)^{\gamma} \quad (7)$$

In practice, setting γ=2 works well, although this value is not critical and other weightings or no weighting at all (i.e., γ=1) may be employed. The matching offset $\Delta_M$ is then computed as the weighted average of the difference excitation, Δ[b], plus a tolerance offset, $\Delta_{Tol}$:

$$\Delta_M=\frac{\sum_b W[b]\Delta[b]}{\sum_b W[b]}+\Delta_{Tol} \quad (8)$$

The weighting in Eqn. 7, when greater than one, causes those portions of the signal excitation EdB[b,t] differing the most from the reference excitation YdB[b] to contribute most to the matching offset $\Delta_M$. The tolerance offset $\Delta_{Tol}$ affects the amount of "fill-in" that occurs when the modification is applied. In practice, setting $\Delta_{Tol}=-12$ dB works well, resulting in the majority of audio spectra being left unmodified through the application of the modification. (In FIGS. 3A-C, it is this negative value of $\Delta_{Tol}$, that causes the matched reference spectrum to fall completely below, rather than commensurate with, the signal spectrum and therefore result in no adjustment of the signal spectrum.)

Once the matched reference excitation has been computed, the modification is applied to generate the modified signal excitation by taking the maximum of EdB[b,t] and $YdB_M[b]$ across bands:

$$EdB_C[b,t]=\max\{EdB[b,t],YdB_M[b]\} \quad (9)$$

The decibel representation of the modified excitation is then converted back to a linear representation:

$$E_C[b,t]=10^{EdB_C[b,t]/10} \quad (10)$$

This modified signal excitation $E_C[b,t]$ then replaces the original signal excitation E[b, t] in the remaining steps of computing loudness according to the psychoacoustic model (i.e. computing specific loudness and summing specific loudness across bands as given in Eqns. 2 and 3)

Figure 6:
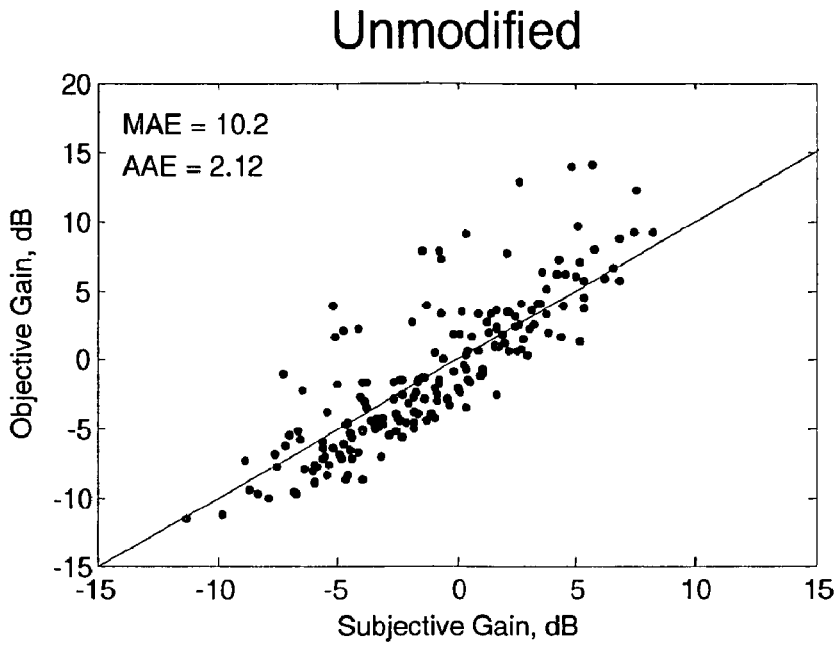
FIG. 6 is a plot that compares objective loudness measures from an unmodified psychoacoustic model to subjective loudness measures for a database of audio recordings.
Figure 7:
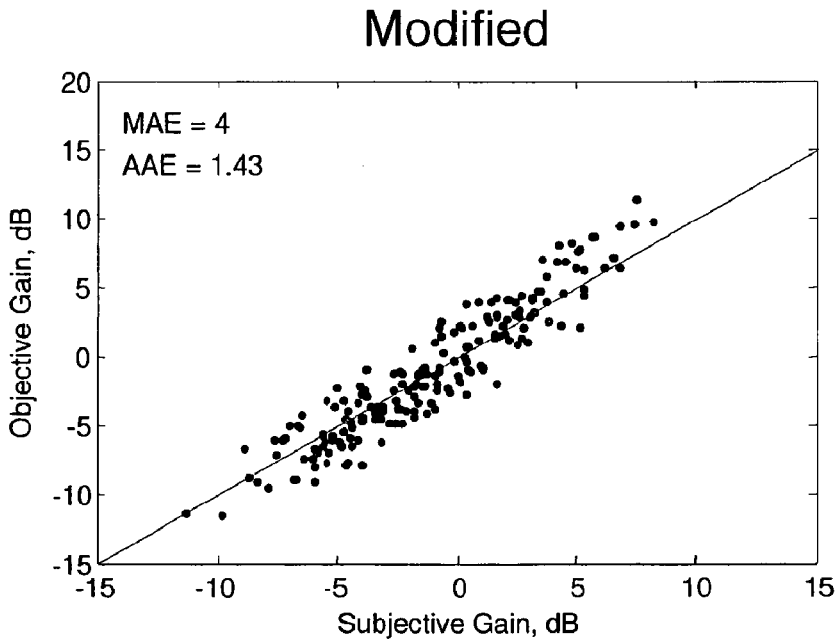
FIG. 7 is a plot that compares objective loudness measures from a psychoacoustic model employing aspects of the present invention to subjective loudness measures for the same database of audio recordings.

To demonstrate the practical utility of the disclosed invention, FIGS. 6 and 7 depict data showing how the unmodified and modified psychoacoustic models, respectively, predict the subjectively assessed loudness of a database of audio recordings. For each test recording in the database, subjects were asked to adjust the volume of the audio to match the loudness of some fixed reference recording. For each test recording, the subjects could instantaneously switch back and forth between the test recording and the reference recording to judge the difference in loudness. For each subject, the final adjusted volume gain in dB was stored for each test recording, and these gains were then averaged across many subjects to generate a subjective loudness measures for each test recording. Both the unmodified and modified psychoacoustic models were then used to generate an objective measure of the loudness for each of the recordings in the database, and these objective measures are compared to the subjective measures in FIGS. 6 and 7. In both figures, the horizontal axis represents the subjective measure in dB and the vertical axis represents the objective measure in dB. Each point in the figure represents a recording in the database, and if the objective measure were to match the subjective measure perfectly, then each point would fall exactly on the diagonal line.

For the unmodified psychoacoustic model in FIG. 6, one notes that most of the data points fall near the diagonal line, but a significant number of outliers exist above the line. Such outliers represent the problem signals discussed earlier, and the unmodified psychoacoustic model rates them too quiet in comparison to the average subjective rating. For the entire database, the Average Absolute Error (AAE) between the objective and subjective measures is 2.12 dB, which is fairly low, but the Maximum Absolute Error reaches a very high 10.2 dB.

FIG. 7 depicts the same data for the modified psychoacoustic model. Here, the majority of the data points are left unchanged from those in FIG. 6 except for the outliers that have been brought in line with the other points clustered around the diagonal. In comparison to the unmodified psychoacoustic model, the AAE is reduced somewhat to 1.43 dB, and the MAE is reduced significantly to 4 dB. The benefit of the disclosed spectral modification on the previously outlying signals is readily apparent.

Implementation

Although in principle the invention may be practiced either in the analog or digital domain (or some combination of the two), in practical embodiments of the invention, audio signals are represented by samples in blocks of data and processing is done in the digital domain.

The invention may be implemented in hardware or software, or a combination of both (e.g., programmable logic arrays). Unless otherwise specified, algorithms and processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein. A number of embodiments of the invention have been described. Nevertheless, it will be understood that various modifications may be made without departing from the spirit and scope of the invention. For example, some of the steps described herein may be order independent, and thus can be performed in an order different from that described.

The invention claimed is:

1. A method for measuring the perceived loudness of an audio signal, comprising obtaining a spectral representation X of the audio signal, matching the level of a reference spectrum Y to the level of the spectral representation X to generate a level-set reference spectrum $Y_M$, wherein $Y_M$ is a level scaling of Y so that the level of the matched reference spectrum is aligned with that of the spectral representation X, the level scaling being a function of the level difference between X and Y across frequency computed as a function of a weighted average of the differences between X and Y across frequency, the portions of the spectrum X that deviate most from the reference spectrum Y being weighted more than other portions, and processing, when the spectral representation X and the level-set reference spectrum $Y_M$ are within a tolerance offset $\Delta_{Tol}$ of each other, the spectral representation X to produce a measure of the perceived loudness of the audio signal, while modifying, when the spectral representation X and the level-set reference spectrum $Y_M$ are not within said tolerance offset $\Delta_{Tol}$ of each other, the spectral representation X to generate a modified spectral representation $X_C$ that conforms more closely to the level-set reference spectrum $Y_M$ than does the spectral representation X by taking the greater one of the level of the spectral representation of the audio signal and the level-set reference shape $Y_M$, and processing the modified spectral representation $X_C$ to produce a measure of the perceived loudness of the audio signal.

2. A method according to claim 1 wherein the spectral representation of the audio signal is an excitation signal that approximates the distribution of energy along the basilar membrane of the inner ear.

3. A method according to claim 1 wherein said reference spectrum Y represents a hypothetical average expected spectral shape.

4. A method according to claim 3 wherein said reference spectrum Y is pre-computed by averaging the spectra of a representative database of ordinary sounds.

5. A method according to claim 1 wherein said reference spectrum Y is fixed.

6. Apparatus comprising means adapted to perform the steps of the method of claim 1.

7. A method for measuring the perceived loudness of an audio signal, comprising obtaining a spectral representation X of the audio signal, matching the level of a reference spectrum Y to the level of the spectral representation X to generate a level-set reference spectrum $Y_M$, wherein $Y_M$ is a level scaling of Y so that the level of the matched reference spectrum is aligned with that of the spectral representation X, the level scaling being a function of the level difference between X and Y across frequency, and processing, when the spectral representation X and the level-set reference spectrum $Y_M$ are within a tolerance offset $\Delta_{Tol}$ of each other, the spectral representation X to produce a measure of the perceived loudness of the audio signal, while modifying, when the spectral representation X and the level-set reference spectrum $Y_M$ are not within said tolerance offset $\Delta_{Tol}$ of each other, the spectral representation X to generate a modified spectral representation $X_C$ that conforms more closely to the level-set reference spectrum $Y_M$ than does the spectral representation X by taking the greater one of the level of the spectral representation of the audio signal and the level-set reference shape $Y_M$, and processing the modified spectral representation $X_C$ to produce a measure of the perceived loudness of the audio signal.

8. A method for measuring the perceived loudness of an audio signal, comprising obtaining a spectral representation X of the audio signal, matching the level of a reference spectrum Y to the level of the spectral representation X to generate a level-set reference spectrum $Y_M$, wherein $Y_M$ is a level scaling of Y so that the level of the matched reference spectrum is aligned with that of the spectral representation X, the level scaling being a function of the level difference between X and Y across frequency computed as a function of a weighted or unweighted average of the differences between X and Y across frequency, and processing, when the spectral representation X and the level-set reference spectrum $Y_M$ are within a tolerance offset $\Delta_{Tol}$ of each other, the spectral representation X to produce a measure of the perceived loudness of the audio signal, while modifying, when the spectral representation X and the level-set reference spectrum $Y_M$ are not within said tolerance offset $\Delta_{Tol}$ of each other, the spectral representation X to generate a modified spectral representation $X_C$ that conforms more closely to the level-set reference spectrum $Y_M$ than does the spectral representation X by taking the greater one of the level of the spectral representation of the audio signal and the level-set reference shape $Y_M$, and processing the modified spectral representation $X_C$ to produce a measure of the perceived loudness of the audio signal.

9. A non-transitory computer-readable storage medium encoded with a computer program for causing a computer to perform the methods of any one of claims 1, 2, 5, 7 and 8.

* * * * *